US009587190B2

(12) United States Patent
Meffert et al.

(10) Patent No.: US 9,587,190 B2
(45) Date of Patent: Mar. 7, 2017

(54) FUEL COMPOSITION AND METHOD OF FORMULATING A FUEL COMPOSITION TO REDUCE REAL-WORLD DRIVING CYCLE PARTICULATE EMISSIONS

(71) Applicants: Michael Wayne Meffert, Chesterfield, VA (US); John David Morris, Gwynn, VA (US); Joseph W. Roos, Mechanicsville, VA (US); Huifang Shao, Midlothian, VA (US)

(72) Inventors: Michael Wayne Meffert, Chesterfield, VA (US); John David Morris, Gwynn, VA (US); Joseph W. Roos, Mechanicsville, VA (US); Huifang Shao, Midlothian, VA (US)

(73) Assignee: Afton Chemical Corporation, Richmond, VA (US)

( * ) Notice: Subject to any disclaimer, the term of this patent is extended or adjusted under 35 U.S.C. 154(b) by 4 days.

(21) Appl. No.: 14/516,627

(22) Filed: Oct. 17, 2014

(65) Prior Publication Data

US 2016/0108332 A1 Apr. 21, 2016

(51) Int. Cl.
*C10L 1/00* (2006.01)
*C10L 1/30* (2006.01)
(Continued)

(52) U.S. Cl.
CPC ..... *C10L 1/305* (2013.01); *C10L 1/04* (2013.01); *C10L 1/08* (2013.01); *C10L 1/1608* (2013.01);
(Continued)

(58) Field of Classification Search
CPC ..... C10L 1/305; C10L 1/1608; C10L 10/10; C10L 10/02; C10L 2200/0236;
(Continued)

(56) References Cited

U.S. PATENT DOCUMENTS 4,104,036 A 8/1978 Chao et al.
2004/0237384 A1* 12/2004 Orr ..... C10L 1/023 44/314
(Continued)

FOREIGN PATENT DOCUMENTS

EP 0529942 A1 3/1993

OTHER PUBLICATIONS

Luftschadstoffemissionen des Strassenverkehrs Folgearbeiten zum BUWAL-Bericht SRU Nr. 255; Real-world driving cycles for emission measurements: ARTEMIS and Swiss cycles; final report; Mar. 2001; 55 pages.
(Continued)

*Primary Examiner* — Cephia D Toomer
(74) *Attorney, Agent, or Firm* — John H. Thomas, P.C.

(57) ABSTRACT

In order to blend fuels to meet specific regulatory and industry requirements, for instance octane requirements, different octane blending components can be used. One added component includes a composition of higher aromatics content. Unfortunately, this aromatic content may increase the particulate emissions of an internal combustion engine when the high aromatic fuel is combusted in that engine. As explained herein, reducing the aromatics content and replacing that octane increasing requirement with an alternative octane enhancer results in a formulated fuel that will have lower particulate emissions in the real-world driving of that engine as compared with a fuel having higher aromatic content.

11 Claims, 5 Drawing Sheets

Fuel Octane Number and Aromatic Content

(51) Int. Cl.

| | |
|---|---|
| ***C10L 1/16*** | (2006.01) |
| ***C10L 10/02*** | (2006.01) |
| ***C10L 10/10*** | (2006.01) |
| ***C10L 1/04*** | (2006.01) |
| ***C10L 1/08*** | (2006.01) |

(52) U.S. Cl.
CPC ..... *C10L 10/02* (2013.01); *C10L 10/10* (2013.01); *C10L 2200/024* (2013.01); *C10L 2200/0227* (2013.01); *C10L 2200/0236* (2013.01)

(58) Field of Classification Search
CPC ..... C10L 2200/024; C10L 2200/0227; C10L 1/04; C10L 1/08
See application file for complete search history.

(56) References Cited

U.S. PATENT DOCUMENTS

2012/0192484 A1 8/2012 Deng
2013/0174641 A1 7/2013 Asano et al.
2014/0301924 A1 10/2014 Morgan

OTHER PUBLICATIONS

Notification of Transmittal of International Search Report and The Written Opinion of the International Searching Authority; International Application No. PCT/US2015/055221; date of mailing Dec. 28, 2015; 9 pages.
Development of a Predictive Model for Gasoline Vehicle Particulate Matter Emissions; SAE 2010-01-2115, Published Oct. 25, 2010; 13 pages.
Vehicle Particulate Emissions presentation dated Oct. 19, 2013; 31 pages.
Informal document No. GRPE-59-18 (59th GRPE, Expert meeting on Euro-5, Jan. 12, 2010,) Proposal of amendment to the Regulation No. 83 (Consolidated version); submitted by the experts from EC ; 282 pages.

* cited by examiner

Fuel Octane Number and Aromatic Content

Distillation Curves of Test Fuels

Emission Rates of the Sub-Cycles of CADC (Urban, Rural and M150)

Particulate and CO Transient Emission Rates Under High Speed-High Load Operation Conditions Transient Particulate Emission Rates and AFR Ratio Under High Speed-High Load Operation Conditions

FUEL COMPOSITION AND METHOD OF FORMULATING A FUEL COMPOSITION TO REDUCE REAL-WORLD DRIVING CYCLE PARTICULATE EMISSIONS

The field of the present invention is internal combustion engine fuels and methods of formulation. Specifically, the invention is directed to fuels that, when combusted, produce less particulate emissions than comparative fuels having relatively higher aromatic content.

BACKGROUND

Vehicle emissions standards generally are being closely examined worldwide by regulatory environmental groups. Standards are being set to lower and lower various types of emissions. Specifically, vehicle particulate emissions limits are being significantly reduced. This includes limits for particulate emissions from gasoline/spark-ignition engines as well as other engine technologies.

In spark-ignition engines, the reduced limits for particulate emissions are solved in part with improving a vehicle hardware design. Attention is being given to injection technology to improve combustion. If not optimized, for instance, injector coking can lead to unfavorable fuel spray and increased particulate emissions. Therefore, technology is evolving to improve hardware performance in order to reduce particulate emissions.

Emissions such as particulate emissions are measured in traditional driving cycle tests; however, these traditional tests do not sufficiently replicate real-world driving conditions. Therefore, traditional test results may not be representative of a vehicle emissions during real-world driving.

SUMMARY

Accordingly, it is an object of the present invention to reduce real-world driving cycle particulate emissions by improving fuel composition. It has been discovered that the fuel aromatic content is closely related to particulate emissions. That is, relatively higher fuel aromatic content leads to relatively higher particulate emissions. By reducing aromatic content and replacing that aromatic content with an octane enhancer having a reduced or nonaromatic content such as an organometallic octane enhancer, a positive result is reduced particulate emissions without sacrificing octane and fuel efficiency.

In one example, a method of reducing the particulate emission from an internal combustion engine begins with providing a base fuel having an aromatic content of at least about 10% by volume. Next, the method includes adding into the base fuel an amount of an octane enhancer to form a fuel formulation, wherein the mixture of the octane enhancer with the base fuel has an aromatic content that is less than the aromatic content of the base fuel without the octane enhancer. The particulate emission from the combustion of the fuel formulation as measured by total particle number (PN) is reduced as compared with particulate emission from the combustion of the base fuel.

DETAILED DESCRIPTION

Figure 1:
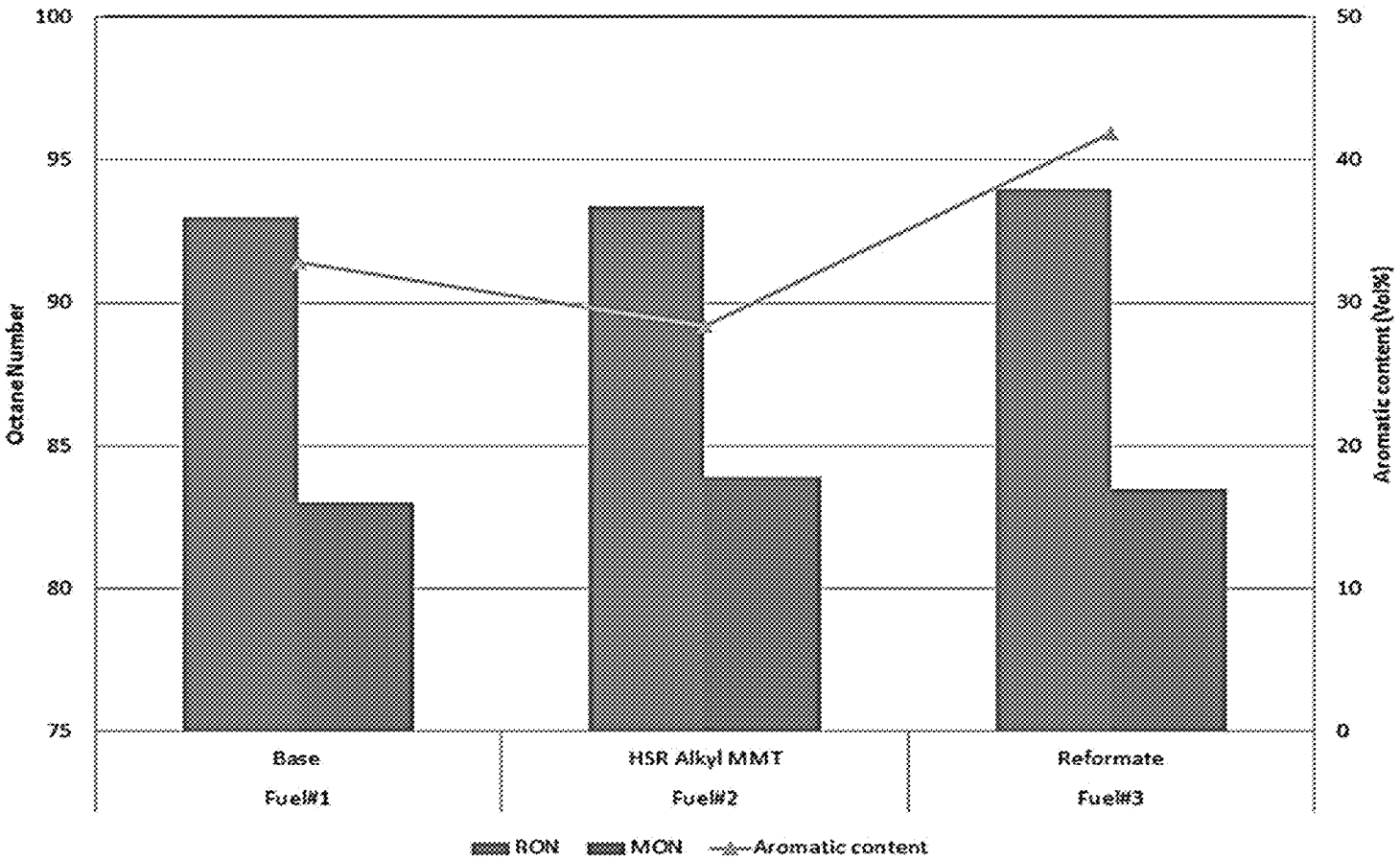
FIG. 1 is a graph illustrating the Research Octane Number (RON), Motor Octane Number (MON) and aromatic content of three comparative fuel formulations—a base fuel, a fuel that contains an octane enhancer, and a reformate fuel.

In order to blend the fuels to meet specific octane requirements, different octane blending components can be used. The detailed components in the finished fuel eventually determine the physical chemical properties of the fuel, and therefore vehicular exhaust emissions resulting from the combustion of the fuel. The method is disclosed to reduce real-world driving cycle particulate emissions through using octane enhancers, for instance such as those containing methylcyclopentadienyl manganese tricarbonyl, whereby a fuel can simultaneously meet octane requirements while lowering aromatic content in the fuel blend.

New and evolving fuel composition requirements can result in many cases in a finished fuel having high aromatics content. The addition of aromatics is required in order for a fuel to have the necessary octane that is called for in a given specification. These highly-refined fuels can include at least 10% aromatic content, or alternatively at least 25%, or still further alternatively at least 35% aromatic content. This relatively high aromatic content ensures that octane requirements are met. However, it has been identified that this aromatic content is the source of substantial particulate emissions.

Modern refining requirements also include ever lowering of the amount of sulfur in a resulting fuel. These fuels may contain less than 50 ppm of sulfur, or alternatively less than 15 ppm of sulfur, or still further alternatively lower than 10 ppm of sulfur. In order to pursue this desulfurization of the fuel in various hydrogenation processes, one result is octane loss in the resulting refined fuel. This octane loss must be compensated for by adding other relatively higher octane blending components. Those components include the high aromatic content components identified earlier.

Another side effect of current refining processes is that the resulting fuel fractions have physically changed in terms of their distillation curves. Well-recognized distillation fuel fractions are referred to as T10, T50, and T90. The T90 fraction typically reflects the volatility of relatively heavy compounds in the fuel. The higher the T90 number is, the harder it is for that fraction of the fuel to vaporize. This is believed to lessen the ease of complete combustion and leads to higher particulate emissions and deposits formation. For the fuel fractions and base fuels described herein, the T90 is at least about 140° C. This T90 is relatively higher than typical historical T90 numbers for fuels that are not refined as they are currently.

Under high speed-high load operation conditions, such as harsh acceleration in the Motorway 150 of Common ARTEMIS Driving Cycle (CADC), incomplete combustion may occur due to the fuel enrichment to accommodate the required power and/or catalyst protection. This type of driving feature is more frequently observed in the real-world use than in traditional regulation cycle (such as New European Driving Cycle (NEDC)), and the emission contribution is higher and more representative of the real-world emission inventory. Depending on the fuel composition and their easiness to be oxidized, vehicular particulate emission can be largely impacted. Those very high particulate emission spikes are confirmed by the coincidence of CO emission spikes under those specific operation modes. Blending fuel with organometallic octane enhancer, instead of increasing aromatic or olefin content, can significantly lower the particulate emissions.

By "fuels" herein is meant one or more fuels suitable for use in the operation of combustion systems including gasolines, unleaded motor and aviation gasolines, and so-called reformulated gasolines which typically contain both hydrocarbons of the gasoline boiling range and fuel-soluble oxygenated blending agents, such as alcohols, ethers and other suitable oxygen-containing organic compounds. Oxygenates suitable for use include methanol, ethanol, isopropanol, t-butanol, mixed $C_1$ to $C_5$ alcohols, methyl tertiary butyl ether, tertiary amyl methyl ether, ethyl tertiary butyl ether and mixed ethers. Oxygenates, when used, may be present in the base fuel in an amount up to about 90% by volume, and preferably only up to about 25% by volume.

As discussed herein, octane enhancers include both organometallic octane enhancers and other octane enhancers generally. These other octane enhancers include ethers and aromatic amines.

For the purpose of the use herein, it is important that the octane enhancer and any carrier liquids blended with the octane enhancer contain reduced or no aromatic content. Importantly, these octane enhancers need to contain less than 20% aromatic content, or alternatively less than 10% aromatic content, or still further alternatively less than 5% aromatic content.

One group of organometallic octane enhancers may contain manganese. Examples of manganese containing organometallic compounds are manganese tricarbonyl compounds.

Suitable manganese tricarbonyl compounds which can be used include cyclopentadienyl manganese tricarbonyl, methylcyclopentadienyl manganese tricarbonyl, dimethylcyclopentadienyl manganese tricarbonyl, trimethylcyclopentadienyl manganese tricarbonyl, tetramethylcyclopentadienyl manganese tricarbonyl, pentamethylcyclopentadienyl manganese tricarbonyl, ethylcyclopentadienyl manganese tricarbonyl, diethylcyclopentadienyl manganese tricarbonyl, propylcyclopentadienyl manganese tricarbonyl, isopropylcyclopentadienyl manganese tricarbonyl, tert-butylcyclopentadienyl manganese tricarbonyl, octylcyclopentadienyl manganese tricarbonyl, dodecylcyclopentadienyl manganese tricarbonyl, ethylmethylcyclopentadienyl manganese tricarbonyl, indenyl manganese tricarbonyl, and the like, including mixtures of two or more such compounds. In one example are the cyclopentadienyl manganese tricarbonyls which are liquid at room temperature such as methylcyclopentadienyl manganese tricarbonyl, ethylcyclopentadienyl manganese tricarbonyl, liquid mixtures of cyclopentadienyl manganese tricarbonyl and methylcyclopentadienyl manganese tricarbonyl, mixtures of methylcyclopentadienyl manganese tricarbonyl and ethylcyclopentadienyl manganese tricarbonyl, etc.

The amount or concentration of the manganese-containing compound in the fuel may be selected based on many factors including the specific attributes of the particular fuel. The treatment rate of the manganese-containing compound can be in excess of 100 mg of manganese/liter, up to about 50 mg/liter, about 1 to about 30 mg/liter, or still further about 5 to about 20 mg/liter.

Another example of a group of organometallic octane enhancers is a group that contains iron. These iron-containing compounds include ferrocene. The treatment rate of these iron-containing compounds is similar to the treatment rate of the manganese-containing compounds above.

Nitrate octane enhancers (also frequently known as ignition improvers) comprise nitrate esters of substituted or unsubstituted aliphatic or cycloaliphatic alcohols which may be monohydric or polyhydric. The organic nitrates may be substituted or unsubstituted alkyl or cycloalkyl nitrates having up to about ten carbon atoms, for example from two to ten carbon atoms. The alkyl group may be either linear or branched (or a mixture of linear and branched alkyl groups). Specific examples of nitrate compounds suitable for use as nitrate combustion improvers include, but are not limited to the following: methyl nitrate, ethyl nitrate, n-propyl nitrate, isopropyl nitrate, allyl nitrate, n-butyl nitrate, isobutyl nitrate, sec-butyl nitrate, tert-butyl nitrate, n-amyl nitrate, isoamyl nitrate, 2-amyl nitrate, 3-amyl nitrate, tert-amyl nitrate, n-hexyl nitrate, n-heptyl nitrate, sec-heptyl nitrate, n-octyl nitrate, 2-ethylhexyl nitrate, sec-octyl nitrate, n-nonyl nitrate, n-decyl nitrate, cyclopentylnitrate, cyclohexyl nitrate, methylcyclohexyl nitrate, isopropylcyclohexyl nitrate, and the like. Also suitable are the nitrate esters of alkoxy substituted aliphatic alcohols such as 2-ethoxyethyl nitrate, 2-(2-ethoxyethoxy)ethyl nitrate, 1-methoxypropyl-2-nitrate, and 4-ethoxybutyl nitrate, as well as diol nitrates such as 1, 6-hexamethylene dinitrate and the like. For example the alkyl nitrates and dinitrates having from five to ten carbon atoms, and most especially mixtures of primary amyl nitrates, mixtures of primary hexyl nitrates, and octyl nitrates such as 2-ethylhexyl nitrate are also included.

EXAMPLE

Figure 2:
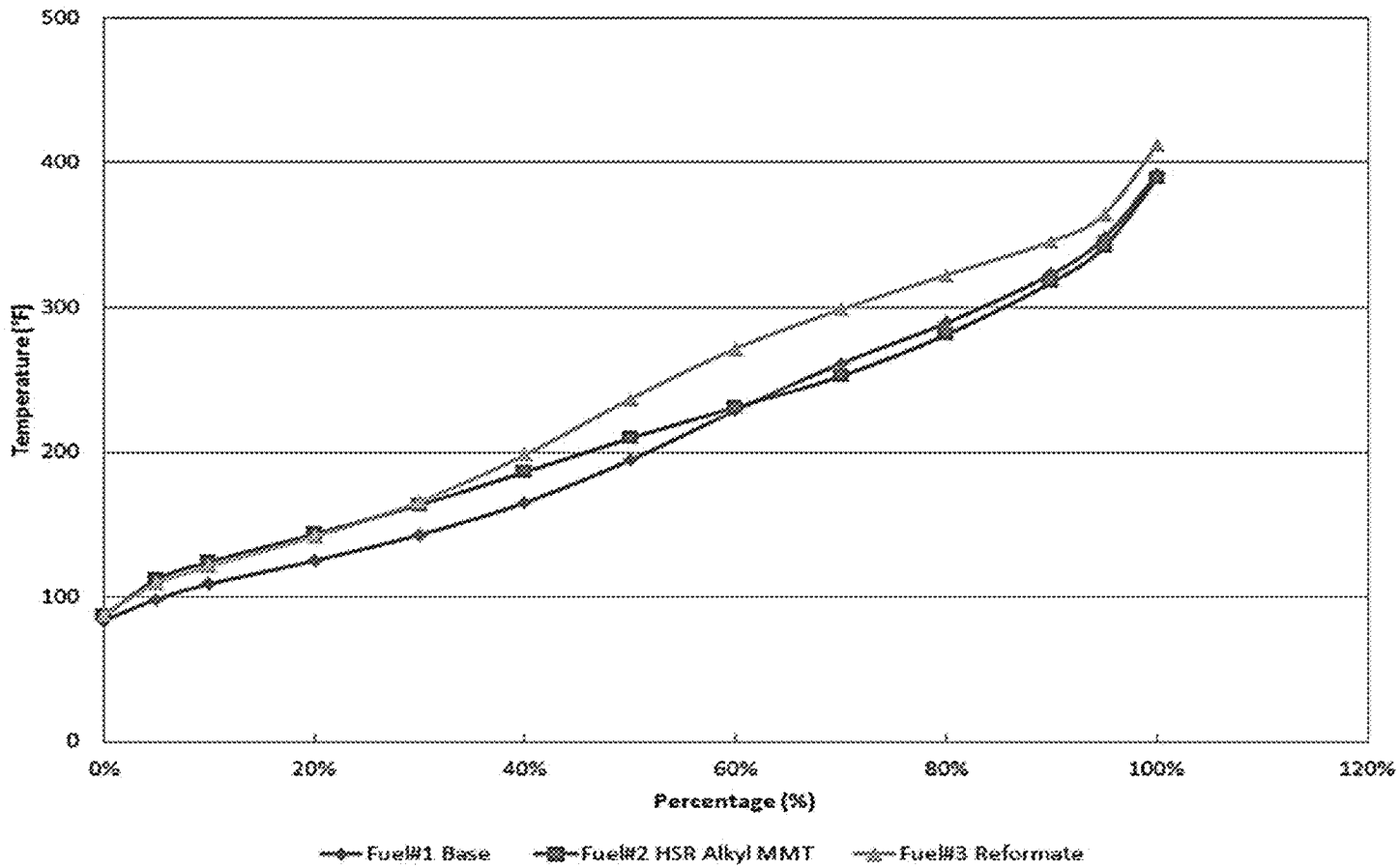
FIG. 2 is a graph that illustrates the distillation curves for the three fuels shown also in FIG. 1.

The example is given in the following with three fuels being blended and tested. Fuel #1 is the base fuel. Non-base fuel blends contain 80% of base fuel and 20% of the combination of HSR, Reformate or alkylates, and final blending fuels are labeled as shown in the Table 1. All three fuels have equivalent Research Octane Number (RON) and Motor Octane Number (MON), but the aromatic content varies from each other (FIG. 1). Fuel #3 has the highest aromatic content (41.91 vol %), followed by base fuel (32.83 vol %), and the lowest one belongs to Fuel #2 (28.39 vol %), i.e. MMT containing fuel. The distillation curves in FIG. 2 indicate that Fuel #2 has substantially higher T50 and T90, relative to other fuels.

TABLE 1

Fuel Blending Matrix

| STREAM | Base | HSR MMT ® | Reformate |
|---|---|---|---|
| COP Gasoline | 100.0% | 80.0% | 80.0% |
| HSR | 0.0% | 9.7% | 5.7% |
| Reformate | 0.0% | 0.0% | 14.3% |
| iso-octane | 0.0% | 10.3% | 0.0% |
| MMT ® (mg/l) | 0.0 | 18.0 | 0.0 |
| Fuel ID | #1 | #2 | #3 |

Figure 3:
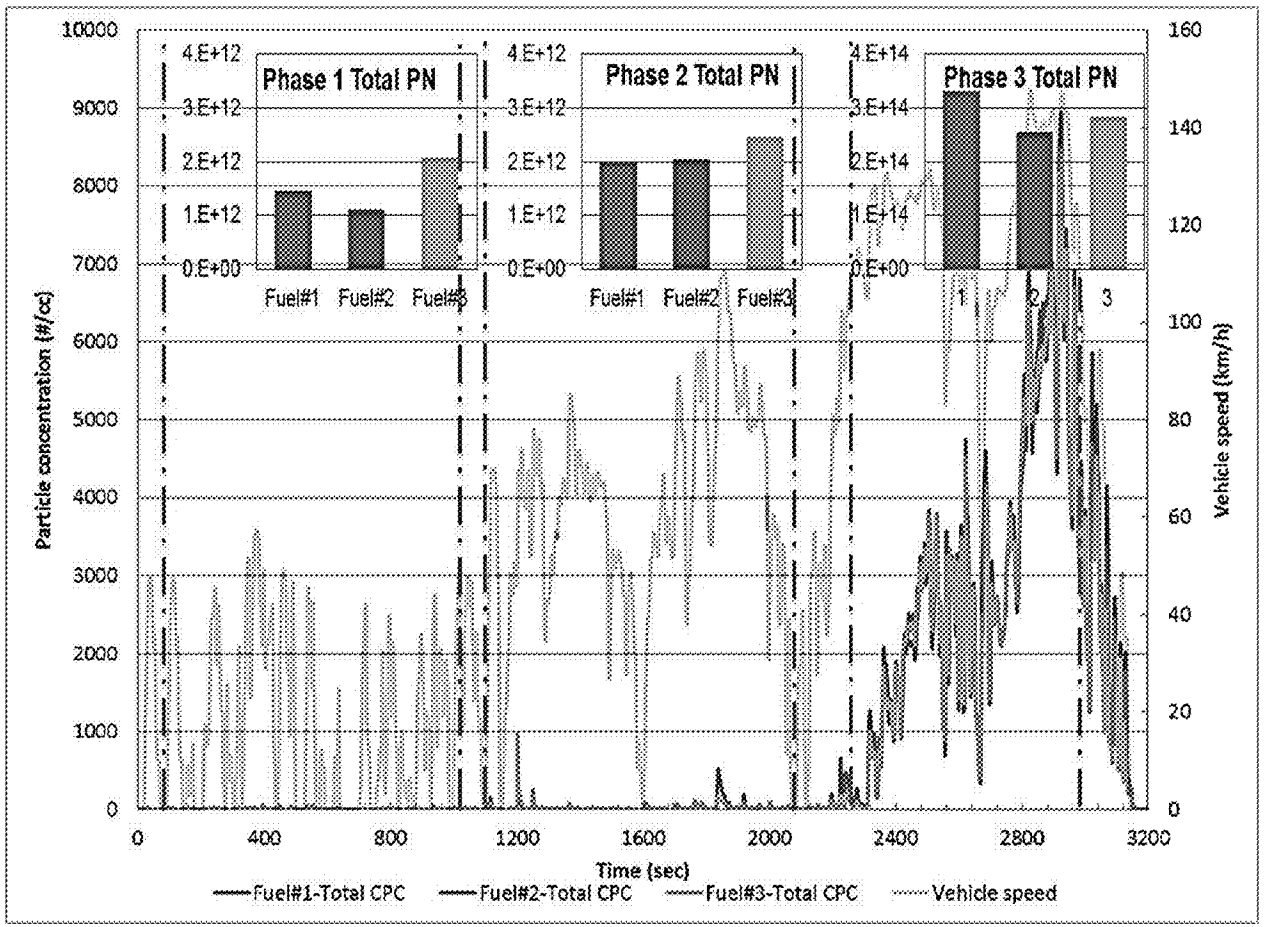
FIG. 3 is a graph that displays particulate emission numbers (PN) (both solids and volatiles) during sub-cycles of the Common ARTEMIS Driving Cycles (CADC)—urban, rural and M150.

FIG. 3 shows the particulate emission (total particle number for both solids and volatiles, PN) for Common ARTEMIS Driving Cycle. Clearly, particulate emission is much higher in phase 3 (motorway part), with approximately two-magnitude order higher than other two phases. In phase 3, Fuel #2, the one that is blended with MMT, emit the lowest total particulate emission, 23% lower than the base fuel, and 10% lower that the reformate fuel. It has to be noted that the particulate emissions reported here are in the form of total particle, which means that not only solids but also volatiles are counted in the measurement. This is because that volatiles can become dominant in the total particulate emission rates under CADC driving condition. The removal of volatiles under this condition may put significant bias on the emission measurement and characterization.

Figure 4:
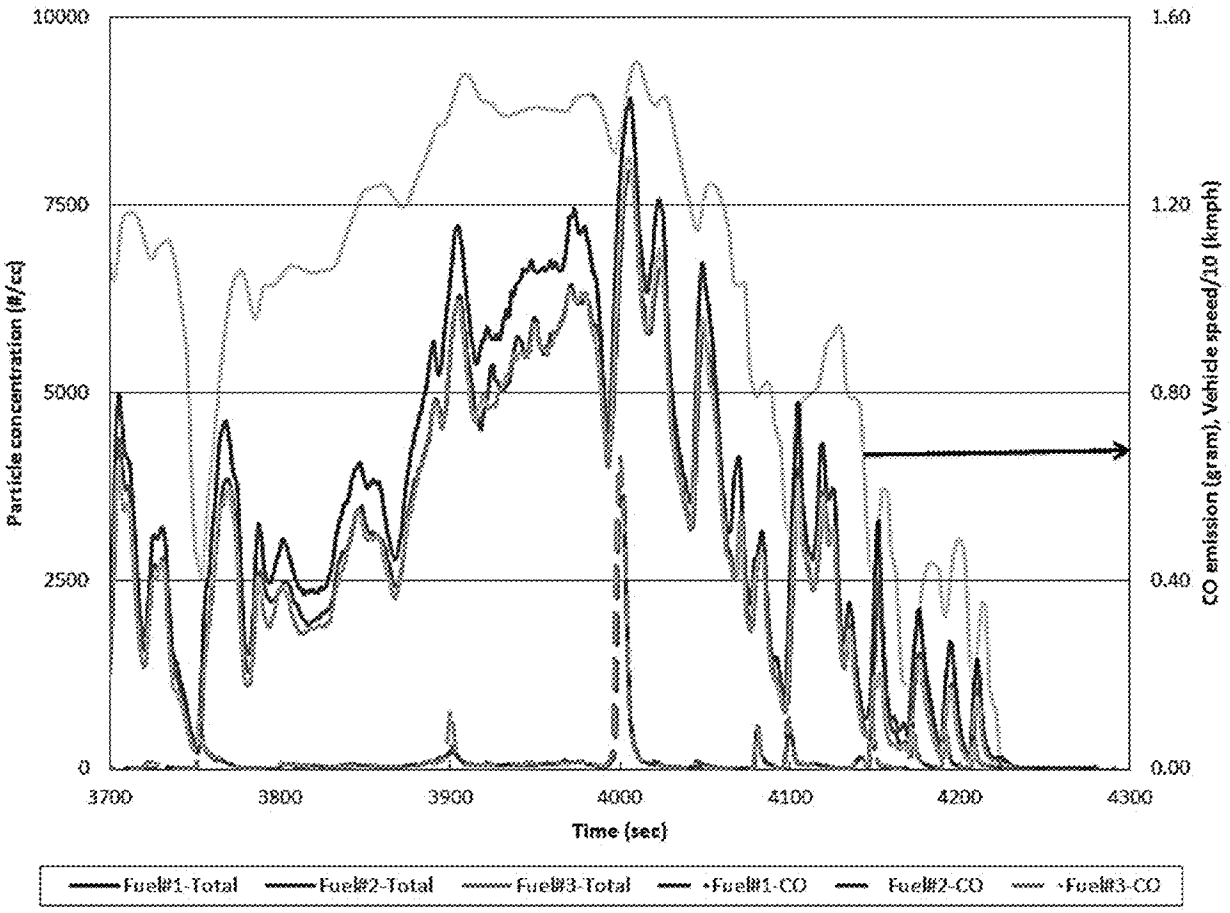
FIG. 4 is a graph that illustrates particulate and carbon monoxide (CO) transient emission rates under high speed-high load operation conditions.
Figure 5:
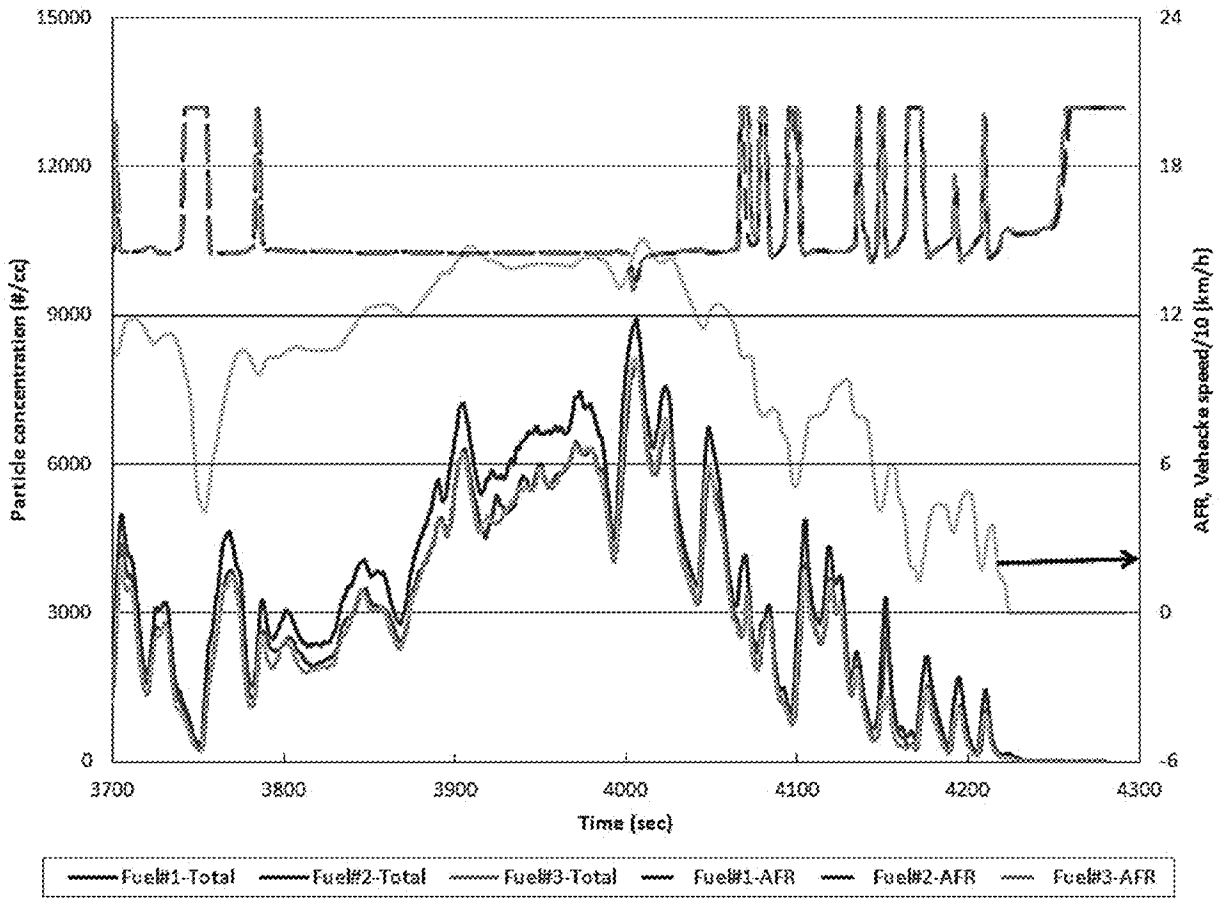
FIG. 5 is a graph that illustrates transient particulate emission rates and air fuel ratio (AFR) under high speed-high load operation conditions.

CO emission spikes in FIG. 4 and AFR ratio shifts in FIG. 5 consistently show that the vehicle operation under that high speed-high load condition can drive the engine to be enrichment. The very high particulate emission under that condition is the combined effect of engine enrichment and incomplete combustion. This very sensitive regime can be very critical for vehicle particulate emission control because their contribution is very significant compared to other operating conditions.

As used herein, the term "octane number" refers to the percentage, by volume, of iso-octane in a mixture of iso-octane (2,2,4-trimethylpentane, an isomer of octane) and normal heptane that would have the same anti-knocking (i.e., autoignition resistance or anti-detonation) capacity as the fuel in question.

As used herein, the term Research Octane Number (RON) refers to simulated fuel performance under low severity engine operation. As used herein, the term Motor Octane Number (MON) refers to simulated fuel performance under more severe (than RON) engine operation that might be incurred at high speed or high load.

Both numbers are measured with a standardized single cylinder, variable compression ratio engine. For both RON and MON, the engine is operated at a constant speed (RPM's) and the compression ratio is increased until the onset of knocking. For RON engine speed is set at 600 rpm, and for MON engine speed is set at 900 rpm. Also, for MON, the fuel is preheated and variable ignition timing is used to further stress the fuel's knock resistance.

As used herein, the term "aromatic" is used to describe an organic molecule having a conjugated planar ring system with delocalized electrons. "Aromatic ring," as used herein, may describe a monocyclic ring, a polycyclic ring, or a heterocyclic ring. Further, "aromatic ring" may be described as joined but not fused aromatic rings. Monocyclic rings may also be described as arenes or aromatic hydrocarbons. Examples of a monocyclic ring include, but are not limited to, benzene, cyclopentene, and cyclopentadiene. Polycyclic rings may also be described as polyaromatic hydrocarbons, polycyclic aromatic hydrocarbons, or polynuclear aromatic hydrocarbons. Polycyclic rings comprise fused aromatic rings where monocyclic rings share connecting bonds. Examples of polycyclic rings include, but not limited to, naphthalene, anthracene, tetracene, or pentacene. Heterocyclic rings may also be described as heteroarenes. Heterocyclic rings contain non-carbon ring atoms, wherein at least one carbon atom of the aromatic ring is replaced by a heteroatom, such as, but not limited to, oxygen, nitrogen, or sulphur. Examples of heterocyclic rings include, but are not limited to, furan, pyridine, benzofuran, isobenzofuran, pyrrole, indole, isoindole, thiophene, benzothiophene, benzo[c] thiophene, imidazole, benzimidazole, purine, pyrazole, indazole, oxazole, benzoxozole, isoxazole, benzisoxazole, thiazole, benzothiazole, quinoline, isoquinoline, pyrazine, quinoxaline, acridine, pyrimidine, quinazoline, pyridazine, or cinnoline.

Other embodiments of the present disclosure will be apparent to those skilled in the art from consideration of the specification and practice of the disclosure disclosed herein. As used throughout the specification and claims, "a" and/or "an" may refer to one or more than one. Unless otherwise indicated, all numbers expressing quantities of ingredients, properties such as molecular weight, percent, ratio, reaction conditions, and so forth used in the specification and claims are to be understood as being modified in all instances by the term "about." Accordingly, unless indicated to the contrary, the numerical parameters set forth in the specification and claims are approximations that may vary depending upon the desired properties sought to be obtained by the present disclosure. At the very least, and not as an attempt to limit the application of the doctrine of equivalents to the scope of the claims, each numerical parameter should at least be construed in light of the number of reported significant digits and by applying ordinary rounding techniques. Notwithstanding that the numerical ranges and parameters setting forth the broad scope of the disclosure are approximations, the numerical values set forth in the specific examples are reported as precisely as possible. Any numerical value, however, inherently contains certain errors necessarily resulting from the standard deviation found in their respective testing measurements. It is intended that the specification and examples be considered as exemplary only, with a true scope and spirit of the disclosure being indicated by the following claims.

That which is claimed is:

1. A method of reducing the particulate emission from an internal combustion engine comprising the steps of:

providing a base fuel having an aromatic content of at least about 10% by volume;

adding into the base fuel an amount of an octane enhancer to form a fuel formulation, wherein the fuel formation containing the octane enhancer and the base fuel has an aromatic content that is less than the aromatic content of the base fuel without the octane enhancer;

wherein (1) the particulate emission from combustion of the fuel formulation as measured by particle number (PN) (both solid and volatiles) is reduced as compared with particulate emission from the combustion of the base fuel, and wherein (2) the octane number of the fuel formulation is substantially the same or higher than the octane number of the base fuel without the octane enhancer.

2. A method of reducing particulate emission as described in claim 1, wherein the aromatic content of the base fuel is at least about 20% by volume.

3. A method of reducing particulate emission as described in claim 1, wherein the aromatic content of the base fuel is at least 35% by volume.

4. A method of reducing particulate emission as described in claim 1, wherein the fuel formulation further comprises an olefin content of at least about 5% by volume.

5. A method of reducing particulate emission as described in claim 4, and wherein the fuel formulation comprises an olefin content of at least about 10%.

6. A method of reducing particulate emission as described in claim 1, wherein the octane enhancer contains an organometallic octane enhancer.

7. A method of reducing particulate emission as described in claim 6, wherein the organometallic octane enhancer comprises manganese, and wherein, the amount of the organometallic octane enhancer is enough that the fuel formulation comprises at least 5 ppm by weight per liter of manganese.

8. A method of reducing particulate emission as described in claim 6, wherein the fuel formulation comprises at least 10 ppm by weight per liter of manganese.

9. A method of reducing particulate emission as described in claim 6, wherein the organometallic octane enhancer comprises iron, and wherein the amount of the organometallic octane enhancer is enough that the fuel formulation comprises at least 5 ppm by weight per liter of iron.

10. A method of reducing particulate emission as described in claim 9, wherein the fuel formulation comprises at least 10 ppm by weight per liter of iron.

11. A method of reducing particulate emission as described in claim 6, wherein the organometallic octane enhancer comprises methylcyclopentadienyl manganese tricarbonyl.

* * * * *